US008100626B2

(12) United States Patent
Shai

(10) Patent No.: US 8,100,626 B2
(45) Date of Patent: Jan. 24, 2012

(54) VERSATILE POWERED LINEAR DRIVE UTILITY MACHINE

(76) Inventor: Moti Shai, Calabasas, CA (US)

( * ) Notice: Subject to any disclaimer, the term of this patent is extended or adjusted under 35 U.S.C. 154(b) by 1215 days.

(21) Appl. No.: 11/378,103

(22) Filed: Mar. 20, 2006

(65) Prior Publication Data

US 2007/0214686 A1 Sep. 20, 2007

(51) Int. Cl.
*B66F 9/18* (2006.01)

(52) U.S. Cl. ..... 414/607; 414/685

(58) Field of Classification Search ..... 414/607, 414/680, 685, 728, 718; 187/267; 37/284
See application file for complete search history.

(56) References Cited

U.S. PATENT DOCUMENTS

| | | | | | |
|---|---|---|---|---|---|
| 237,410 | A | * | 2/1881 | Rouse | 171/100 |
| 617,830 | A | * | 1/1899 | Herran | 37/285 |
| 1,021,402 | A | * | 3/1912 | Fogarty | 414/739 |
| 1,025,320 | A | * | 5/1912 | Shields et al. | 414/721 |
| 1,232,307 | A | * | 7/1917 | Hervey | 414/685 |
| 1,500,104 | A | * | 7/1924 | Carlberg | 414/717 |
| 1,576,336 | A | * | 3/1926 | Kronsbein | 298/19 R |
| 1,615,284 | A | * | 1/1927 | Kennedy | 414/688 |
| 2,148,932 | A | * | 2/1939 | Fisher | 414/541 |
| 2,272,648 | A | * | 2/1942 | Smith | 414/685 |
| 2,520,033 | A | | 8/1950 | Fuelling | |
| 2,571,113 | A | | 10/1951 | Crosby | |
| 2,703,227 | A | | 3/1955 | Hughes | |
| 2,846,785 | A | * | 8/1958 | Underwood | 37/270 |
| 3,406,761 | A | * | 10/1968 | Ryan | 172/42 |
| 4,179,828 | A | * | 12/1979 | Brunty | 37/241 |
| 4,268,175 | A | | 5/1981 | Norlie et al. | |
| 4,324,317 | A | * | 4/1982 | Winkelblech | 187/267 |
| 4,526,413 | A | | 7/1985 | Williams | |
| 4,621,562 | A | | 11/1986 | Carr et al. | |
| 4,778,330 | A | * | 10/1988 | Maileux et al. | 414/629 |
| 5,195,865 | A | | 3/1993 | Koel | |
| 5,261,739 | A | | 11/1993 | Costa Goncalves et al. | |
| 5,596,824 | A | | 1/1997 | Scott et al. | |
| 5,672,044 | A | | 9/1997 | Lemelsonj | |
| 5,810,408 | A | * | 9/1998 | Armstrong | 294/57 |
| 5,918,921 | A | * | 7/1999 | Samuelson | 294/54.5 |
| 5,938,382 | A | * | 8/1999 | Andre et al. | 410/24 |
| 6,530,740 | B2 | * | 3/2003 | Kim | 414/490 |
| 6,735,887 | B1 | * | 5/2004 | Muzzammel | 37/285 |
| 7,681,336 | B2 | * | 3/2010 | Noonan et al. | 37/265 |
| 2007/0137944 | A1 | * | 6/2007 | Lam | 187/267 |

FOREIGN PATENT DOCUMENTS

CN 201047168 * 4/2008

* cited by examiner

*Primary Examiner* — Joshua Rudawitz

(57) ABSTRACT

A linear drive mechanism is configured with a vertical column mounted on a mobile base containing a reversible electric motor that is coupled to drive a threaded shaft located centrally within the column. A driving member, engaging the threaded shaft and constrained to vertical travel in a longitudinal slot in a side of the column, can be driven by the motor in a linear path in either direction between the ends of the column. The drive mechanism is adaptable to power a wide variety of auxiliary mechanisms linearly and/or rotationally to perform specific tasks with substantial reductions of manual labor in construction and material-moving tasks including shoveling, picking, hoeing, digging trenches and holes, lifting, e.g. as with a hoist, crane or vertical conveyor, pulling, mixing, e.g. concrete, handling and installing panel workpieces such as drywall, and driving posts.

1 Claim, 12 Drawing Sheets

FIG. 4A
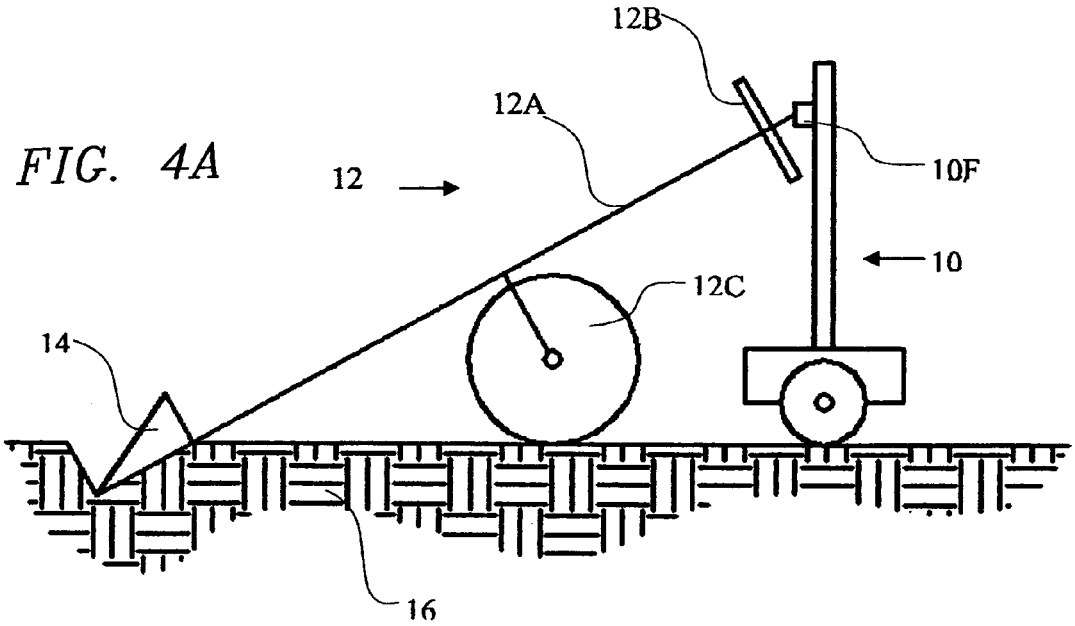
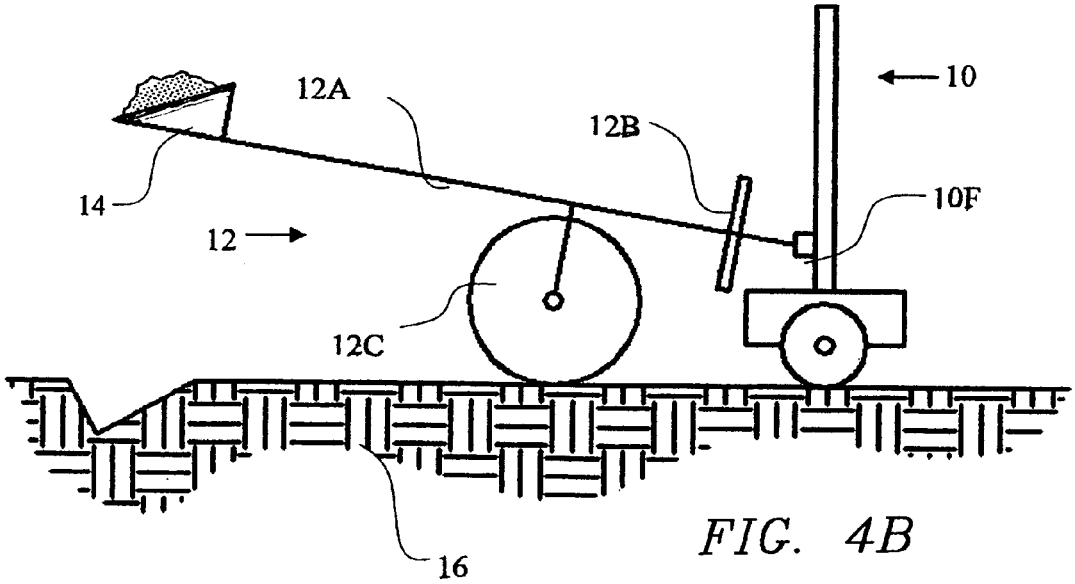
FIG. 4B

FIG. 5
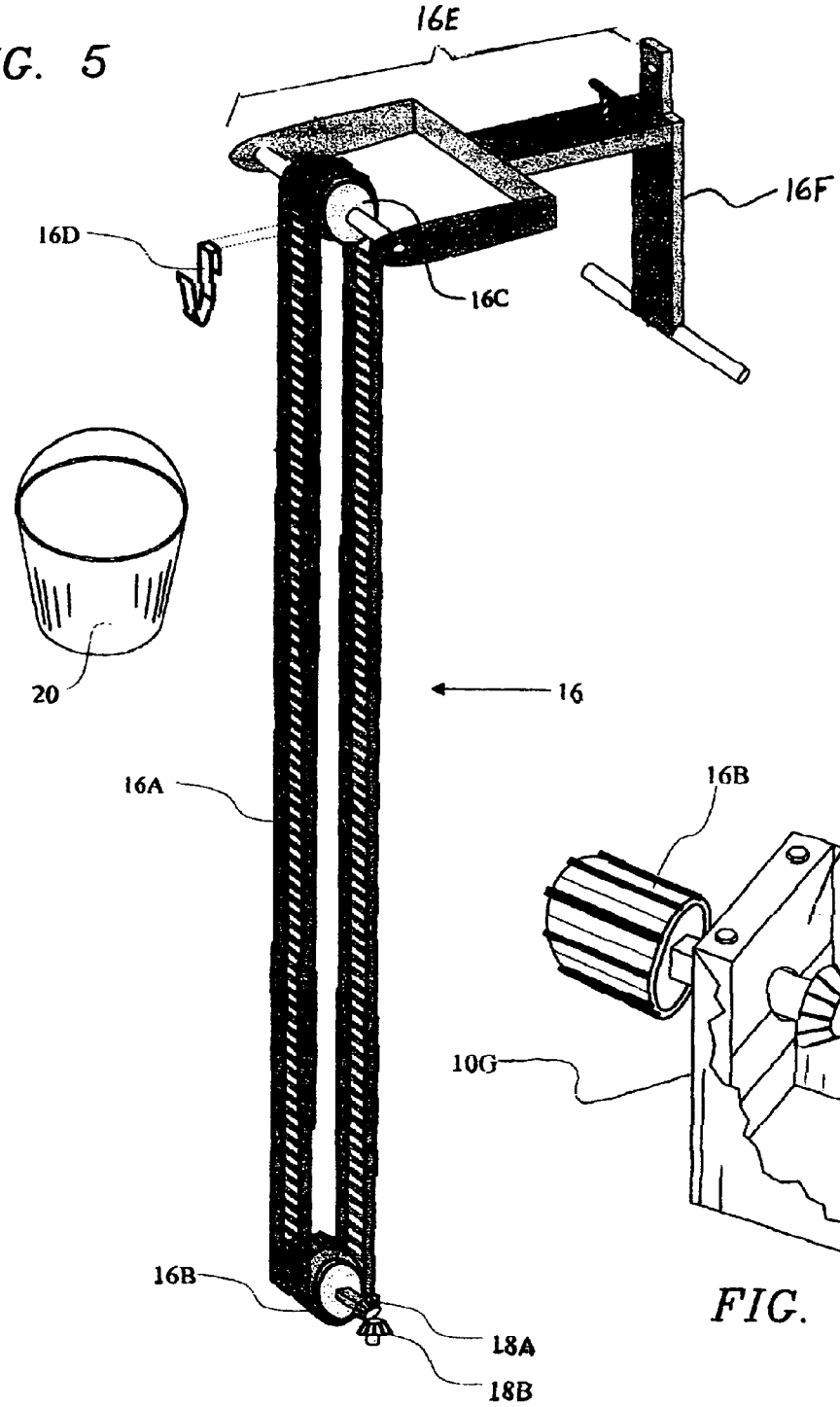
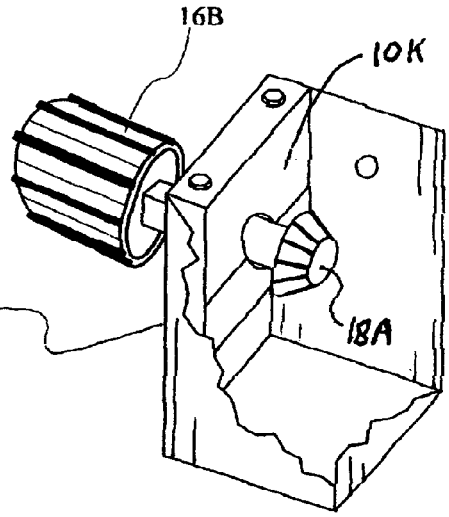
FIG. 5A

VERSATILE POWERED LINEAR DRIVE UTILITY MACHINE

FIELD OF THE INVENTION

The present invention relates to the field of powered utility machines and more particularly a versatile motor-driven linear drive utility machine that supplants manual labor in a variety of construction and material-moving tasks including shoveling, digging trenches and drilling holes, lifting and setting concrete blocks, setting posts, picking, lifting, e.g. as with a hoist or crane, pulling, mixing, e.g. concrete, and handling drywall or other panels.

BACKGROUND OF THE INVENTION

There are many tasks in the fields of construction, soil-moving and the like that fall into a category that although they are particularly difficult to perform manually, they do not merit deployment of regular heavy duty powered equipment such as tractors, bulldozers, cranes, hoists, winches, and the like, either because of prohibitive costs, inaccessible location, space limitations, or any of a number of other reasons or circumstances.

DISCUSSION OF KNOWN ART

Examples of powered devices that supplant manual labor include concrete mixers, power saws, powered lawn mowers, powered hedge clippers, leaf blowers, roto-tillers, etc. Despite these and other labor savers, there remain many manual tasks that are overly strenuous for manual labor and that would become more efficient overall if a moderate amount of machine power were made available in versatile manner to apply to the various physical tasks.

OBJECTS OF THE INVENTION

It is a primary object of the present invention to provide a versatile and readily portable motorized mechanism to assist with a variety of heavy duty tasks that are customarily performed manually for various reasons including excessive size, cost or unavailability of known machines such as tractors, cranes, etc.

It is a further object of the present invention to provide a utility drive power source that is inexpensive and readily portable and yet high versatile and readily adaptable to avoid or supplement manual labor in a wide range of labor-intensive tasks.

SUMMARY OF THE INVENTION

The objects of the invention have been met by a linear drive mechanism having an elongated column mounted on a mobile base and extending upwardly therefrom when the base is in a normal attitude on horizontal ground, containing a motor that drives a threaded shaft located centrally within the column and engaging a driving member that, under user control, can be driven by the motor in a linear path in either direction between the ends of the column, and that can be coupled to any of a variety of auxiliary mechanisms dedicated to perform specific tasks.

BRIEF DESCRIPTION OF THE DRAWINGS

The above and further objects, features and advantages of the present invention will be more fully understood from the following description taken with the accompanying drawings in which:

FIGS. 4A and 4B depict, in an elevational side view, two sequential steps in the process of deploying the shoveling mechanism of FIG. 2.

FIG. 5 is a three-dimensional view of a vertical conveyer accessory of the present invention.

FIG. 5A is an enlarged view of a lower portion of FIG. 5 and a portion of an associated enclosure.

DETAILED DESCRIPTION

Figure 1:
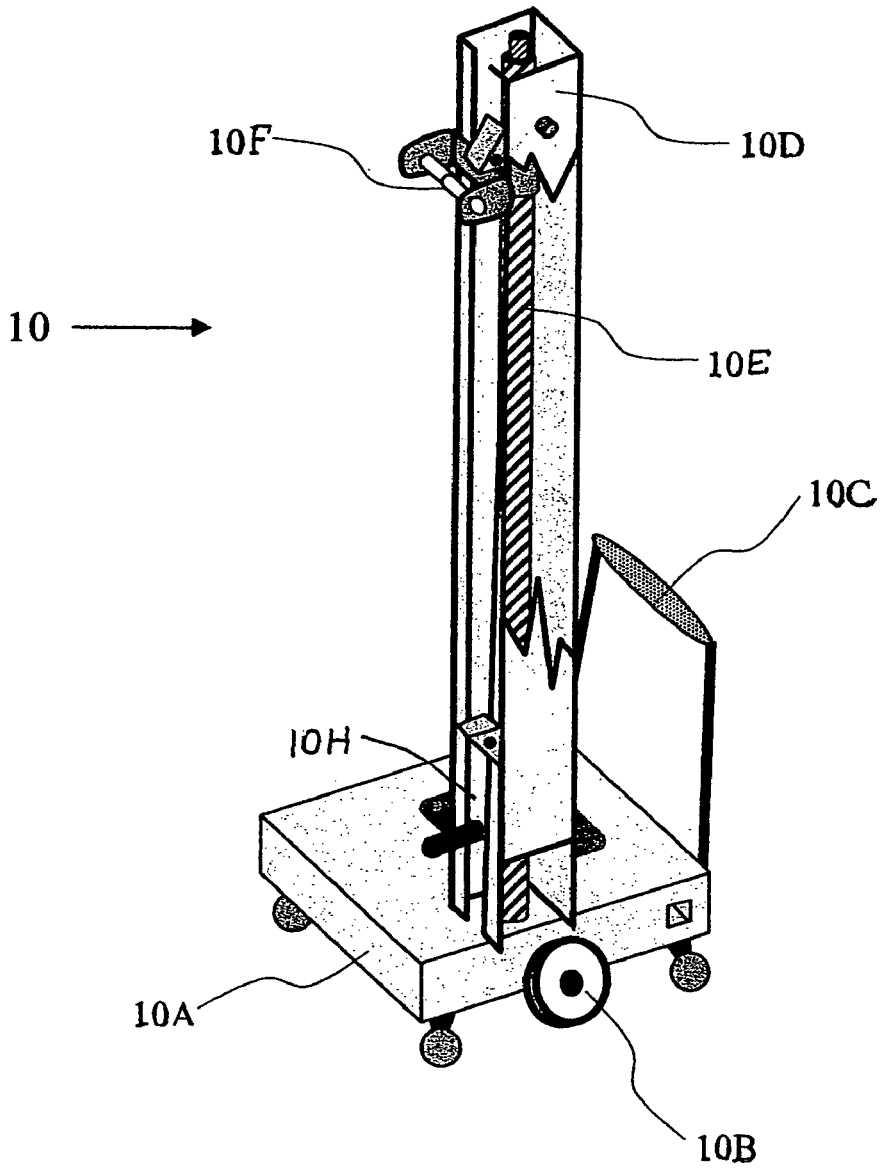
FIG. 1 is a three-dimensional view of a linear drive machine according to the present invention.

FIG. 1 is a three-dimensional view of the a linear driver machine 10 representing the primary element of the present invention in basic form. A base enclosure 10A supported by a pair of wheels 10B and fitted with a handle 10C supports a firmly fastened hollow column 10D that is generally square in cross-section and contains a centrally-located threaded shaft 10E shown in the cutaway region. Shaft 10E runs in bearings in the top and bottom regions of column 10D, and is drivably coupled by a reduction gear set to a reversible electric motor located in base enclosure 10A. A driving member 10F, engaging the threads of shaft 10E is thus driven by rotation thereof to travel vertically in the elongated slot shown that runs the length of column 10D.

Drive machine 10 is made adaptable to be removably coupled operationally to supply drive power to any of a variety of machine loads in either or both of two modes:

(1) in the linear mode via driving member 10F for variable-height and reciprocating activities such as a shoveling system, a pick system, a lift platform/scaffold, a concrete block installing system, a handler and installer for construction panels such as hardwall workpiece sheets, a concrete mixer and a post driver;

(2) in the rotational mode, with the addition of a bevel gear attachment at the top end of shaft 10E for continuous rotation as required by machines such as a vertical conveyor, a hoist, a winch, and a ground drill. Drive power can be delivered by the drive machine 10 in both the linear and rotational modes simultaneously if necessary.

An on-off switch to control the motor may be provided preferably located on or near the handle 10C. For many purposes it would be preferable to utilize a remote control, which may be wired or wireless, e.g. as applied to door openers.

Figures 2, 3:
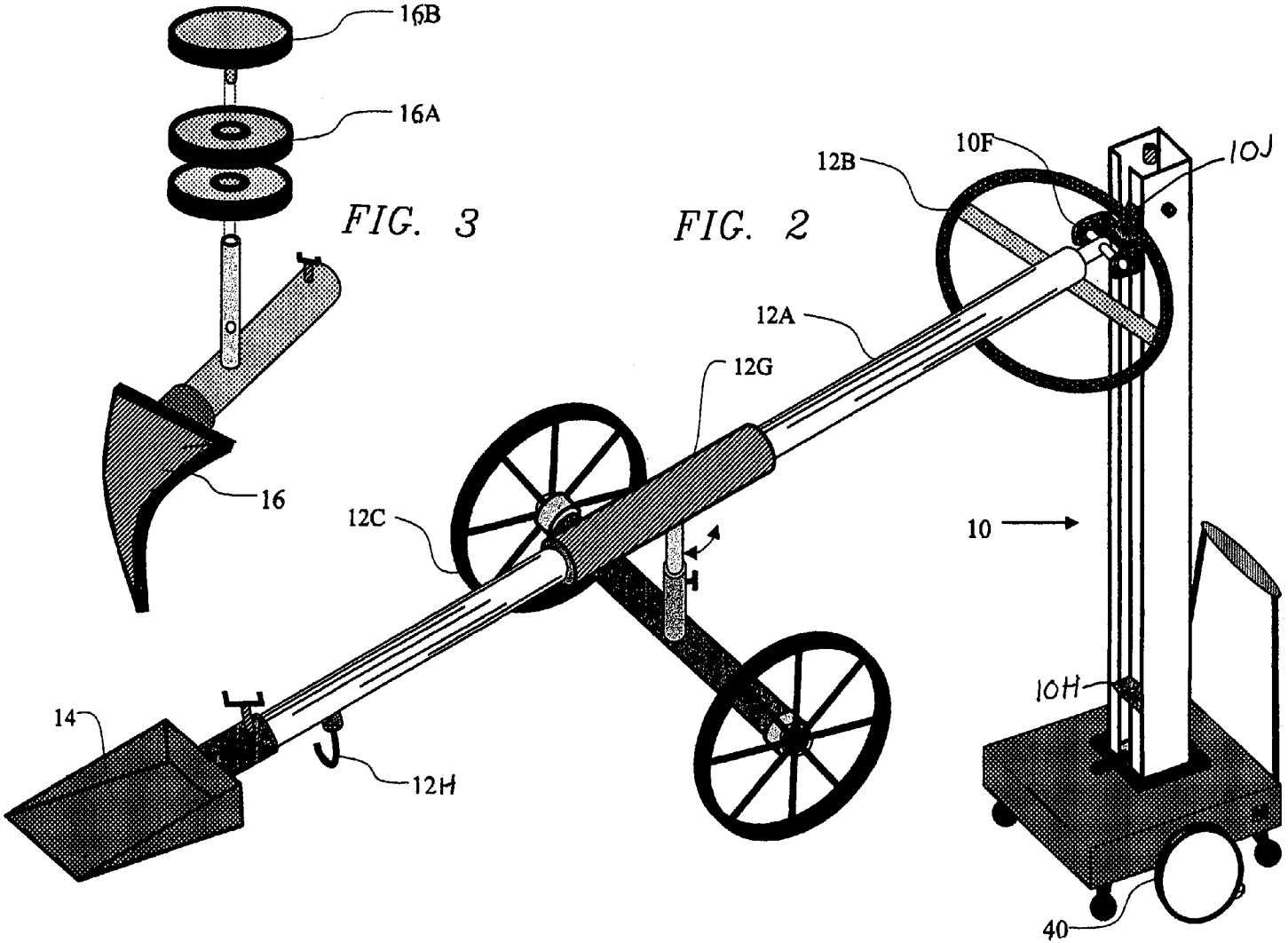
FIG. 2 is three-dimensional view showing the linear drive machine of FIG. 1 operationally connected to a shoveling mechanism.
FIG. 3 is a three-dimensional partial view of a pick attachment that can be utilized in place of the shovel attachment in FIG. 2.

FIG. 2 is three-dimensional view showing the linear driver 10 of FIG. 1 operationally connected to a shoveling mechanism 12 including a tubular main beam 12A fitted with a handwheel 12B and supported adjustably on a pair of wheels 12C joined by an axle as shown. The right hand end of beam 12A, shown at its upper location, receives drive power from driving member 10F of linear driver 10 which is removably attached in a manner to allow pivoting in a vertical plane. The opposite lower left hand working end of beam 12A serves the handle of an attached shovel 14 which can be rotated by handwheel 12B for purposes of dumping loaded material via rotation of beam 12A which can be made rotatable about an inner shaft at the driving end. For other purposes where rotation of the beam 12A and handwheel 12B is not wanted, it may be locked against rotation by a fastener such as a pin that still allows the vertical pivot action between beam 12A and drive member 10F.

Linear driver 10 is provided at bottom and top with electromechanical toggle mechanisms 10H and 10J providing stop point with the capabilities of automatic reversal for cyclic or continuous reciprocation and/or release of the driving member 10F from the threaded drive shaft as an alternative to manual on-off motor control by the user for purposes of automatic reciprocating action or rise/fall freedom, e.g. for hammering or tamping.

A hook 12H is provided near the working end of beam 12A for direct hoisting capability.

FIG. 3 is a three-dimensional partial view of a pick attachment 16 that can be installed on beam 12A of FIG. 2 instead of shovel 14, with beam 12A locked against rotation, for tasks that are often performed manually with a pickaxe or hoe, such as breaking up hard soil. For this operation the motor is utilized to drive member 10 to the bottom so as to lift the pick attachment 16 to its highest location. Lower toggle mechanism 10H (FIG. 2) is operated in a manner to disengage drive member 10F from the shaft threads, allowing the pick attachment 16 to fall to the ground and perform the pick function, while upper toggle mechanism 10J re-engages the shaft threads so that the process repeats and continues automatically.

Additional weights 16A can be added on top of pick attachment 16 as required for difficult work: the annular weights are retained by a cap member 16B.

Furthermore pick attachment 16 (optionally along with beam 12A) can be released, rotated a half turn and re-fastened so that the weights 16A may be used as a tamper for soil compaction by operating in a manner similar to the pick.

FIG. 4A depicts, in an elevational side view utilizing simplified "stick" representation, the shoveling mechanism 12, shown with shovel 14 having been directed manually via handwheel 12B into ground 16, where shovel 14 can be forced further to load it with soil. Then, to lift the shovel 14, the linear driver 10 is activated in a direction to move driving member 14F downward so that wheels 12C and their axle form a fulcrum that enables the beam 12A to rotationally tilt and lift the shovel 14 along with any contained load.

FIG. 4B depicts the items in FIG. 4A with driving member 10F having been driven down to the lower position shown so that the end of beam 12A with loaded shovel 14 becomes elevated to the location shown. In this condition the shoveling mechanism 12 and the linear driver 10 may be moved to a desired location, where the shovel 14 can then be rotated via handwheel 12B to dump the shovelful. This process is repeated as required.

FIG. 5 is a three-dimensional view of a vertical conveyer accessory 16 of the present invention. A vertical conveyor belt 16A, made to be adjustable in length, extends between a driven sprocket 16B at the bottom and an idler sprocket 16C at the top, mounted on a bracket assembly 16E which is typically attached to and/or supported by building structure. A hinged member 16F is shown in its vertical position as it would be utilized in hanging over a wall or roof parapet, i.e. a low peripheral wall around a flat roof of a building. Member 16F can be hinged to a horizontal position and weighted or fastened on an ordinary flat roof.

An S-shaped lift hook 16D can be inserted into any one of the series of perforations configured in conveyor belt 16A over its entire length. Load items such as bucket 20 are hung on hook 16D near the lower or upper end of conveyor 16 and then the motor of the linear drive machine is operated by the user accordingly to elevate or lower the load.

Sprocket 16B is attached by a short shaft to bevel gear 18A which is driven by engagement with bevel gear 18B, installed as an accessory onto the top end of the threaded shaft (10E, FIG. 1) of the linear drive machine 10 of the present invention. Typically for such continuous rotation, the driving member (10F, FIG. 1) may be removed or otherwise disengaged from the threaded shaft 10E, e.g. by the toggling mechanisms 10H 10J (FIG. 2) and/or by providing a non-threaded portion at the top or bottom end of threaded shaft 10E.

FIG. 5A is a three-dimensional view of sprocket 16B attached by a short shaft to bevel gear 18A which is contained in a metal enclosure box 10G, shown partially cut away to reveal a bearing 10K surrounding the short shaft. The enclosure box 10G, open at the bottom, fits over and fastens onto the top end of column 10D of the drive machine 10 (FIG. 1).

Figure 6:
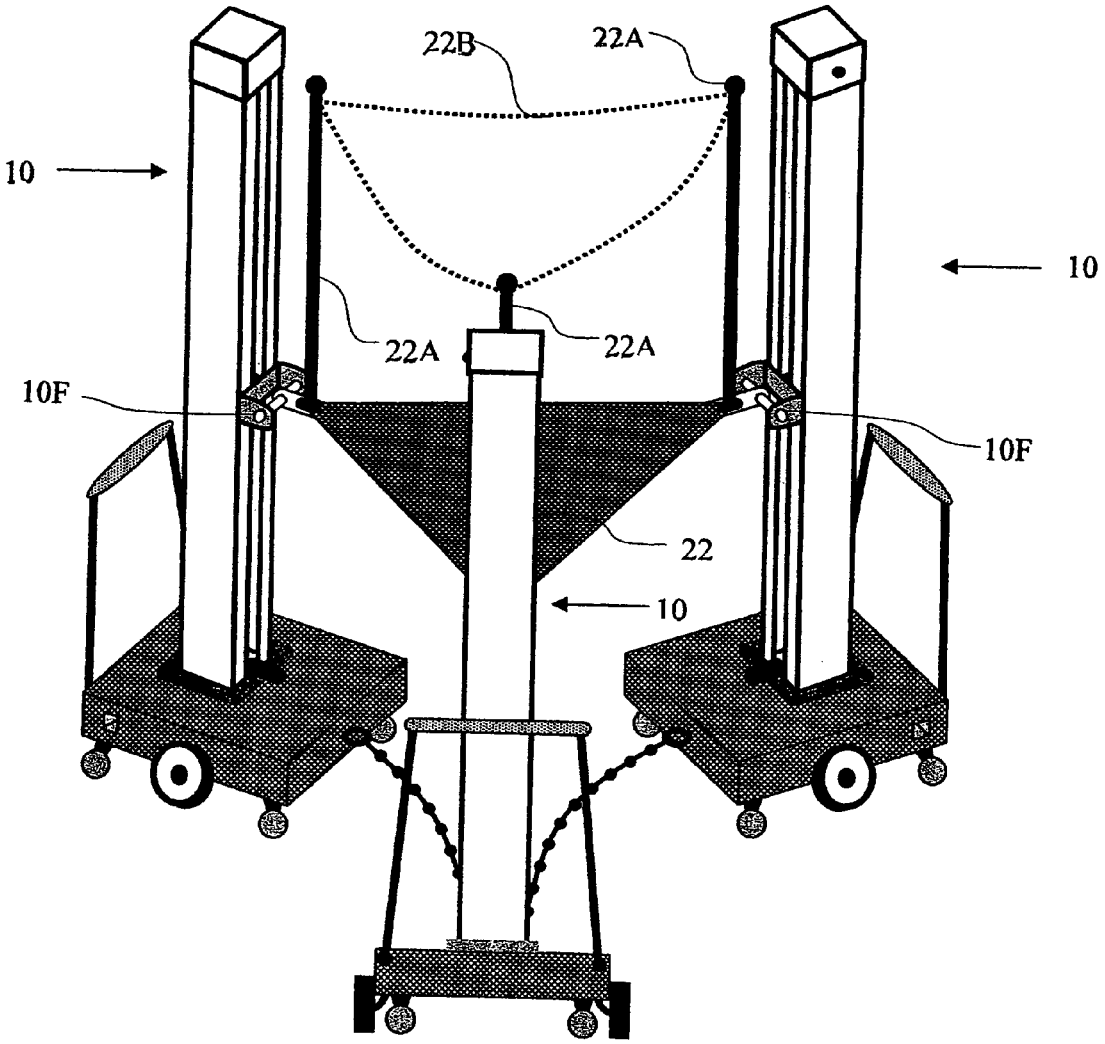
FIG. 6 is a three-dimensional view showing three linear drive machines of the present invention as in FIG. 1, deployed together to support a variable-height utility platform or scaffold.

FIG. 6 is a three-dimensional view showing three linear drive machines 10 of the present invention as in FIG. 1, deployed together to support and elevate or lower a support structure 22 which can be a platform, scaffold or load container which in this example is triangular in shape and attached at each vertex to a corresponding driving member 10F. The motors of the three linear drive machines 10 are operated simultaneously and in the same direction to keep the support structure 22 level. The platform structure 22 can be equipped with corner posts 22A of any desired height, and may support a chain railing 22B, as indicated by the dotted line, for purposes of personal safety when used as a scaffold. Alternatively the railing could be made solid. Also sidewalls could be added to form a container instead of a platform.

Figure 7:
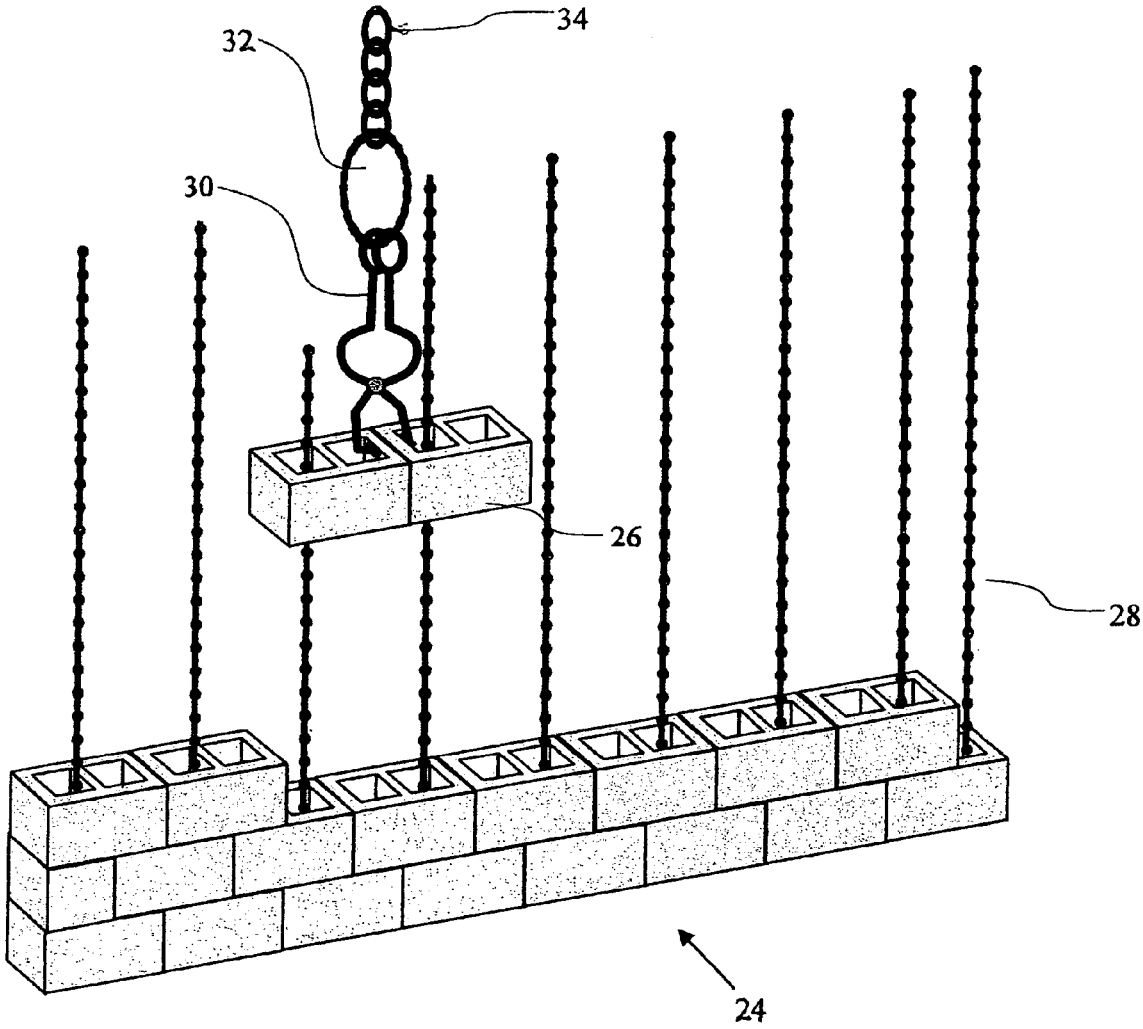
FIG. 7 is a three-dimensional view of a reinforced block wall under construction utilizing the present invention as a hoist.

FIG. 7 is a three-dimensional view of a block wall 24 being constructed from concrete blocks 26 and vertically oriented rebars (steel reinforcing bars) 28, utilizing a linear drive machine of the present invention (not shown in FIG. 7: refer to FIG. 1) serving as a hoist or crane. Two blocks 26, having been picked up simultaneously from their previous resting place, are suspended as shown by a pickup clamp 30, ring 32 and a chain 34 which is ultimately attached operationally to the driving member (10F) of the linear drive machine (10, FIG. 1). The blocks 26 are elevated as required, moved into place over the rebars 28 then lowered, as shown part way down, into their final place on wall 24. Pickup clamp 30 can also seize and hoist a single concrete block 26.

Figure 8:
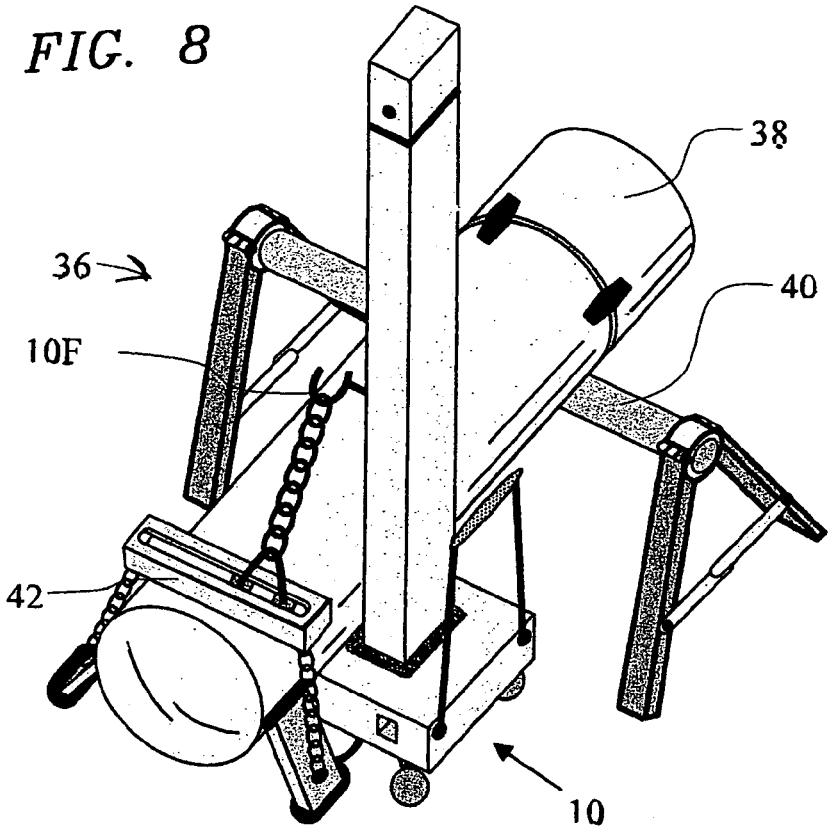
FIG. 8 is a three-dimensional view of a concrete mixing apparatus powered by the linear drive machine of the present invention.

FIG. 8 is a three-dimensional view of a concrete mixing apparatus 36 powered by a linear drive machine 10 of the present invention. A long, generally cylindrical barrel 38, loaded with wet concrete to be mixed, is generally supported as shown by a four-legged stand 40 while an end region is supported by an agitating harness including a slider box 42 with a pair of internal roller sliders connected to a hook on the driving member 10F of linear drive machine 10. Vertical movement of driving member 10F up and down in response to motor drive causes the barrel 38 to move up and down as well as left and right in a rolling motion to mix the concrete in barrel 38.

Figure 8A:
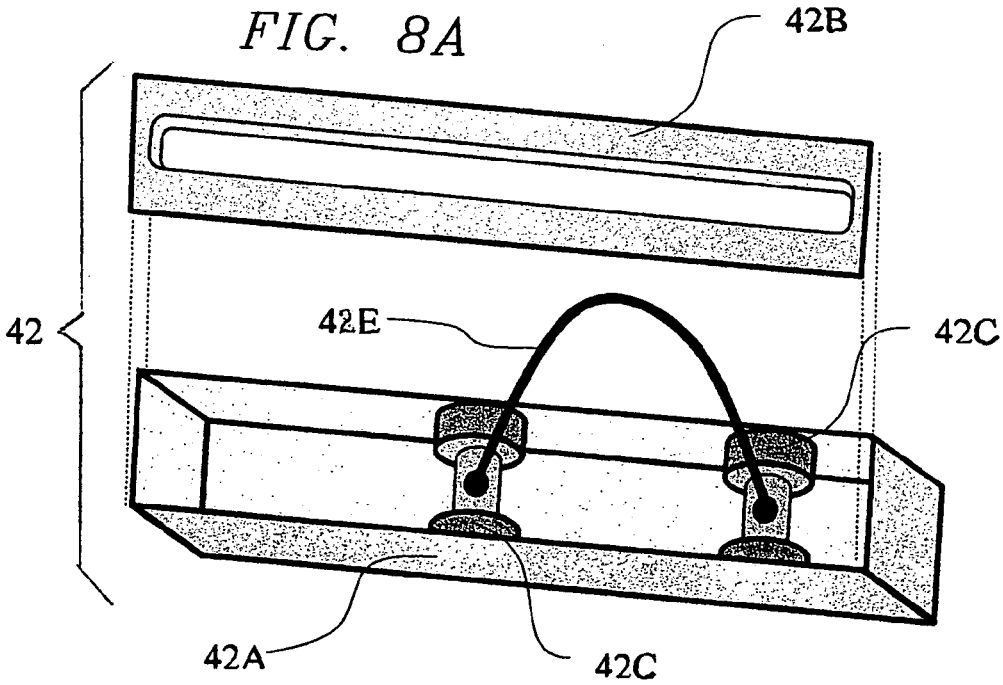
FIG. 8A is a three-dimensional view of a sliding yoke portion of the mixing apparatus in FIG. 8.

FIG. 8A is an enlarged three-dimensional view of the slide box 42 of FIG. 8, showing the main enclosure 42A, slotted cover 42B and a pair of roller sliders 42C captivated inside, connected by a cable link 42E.

Figure 9:
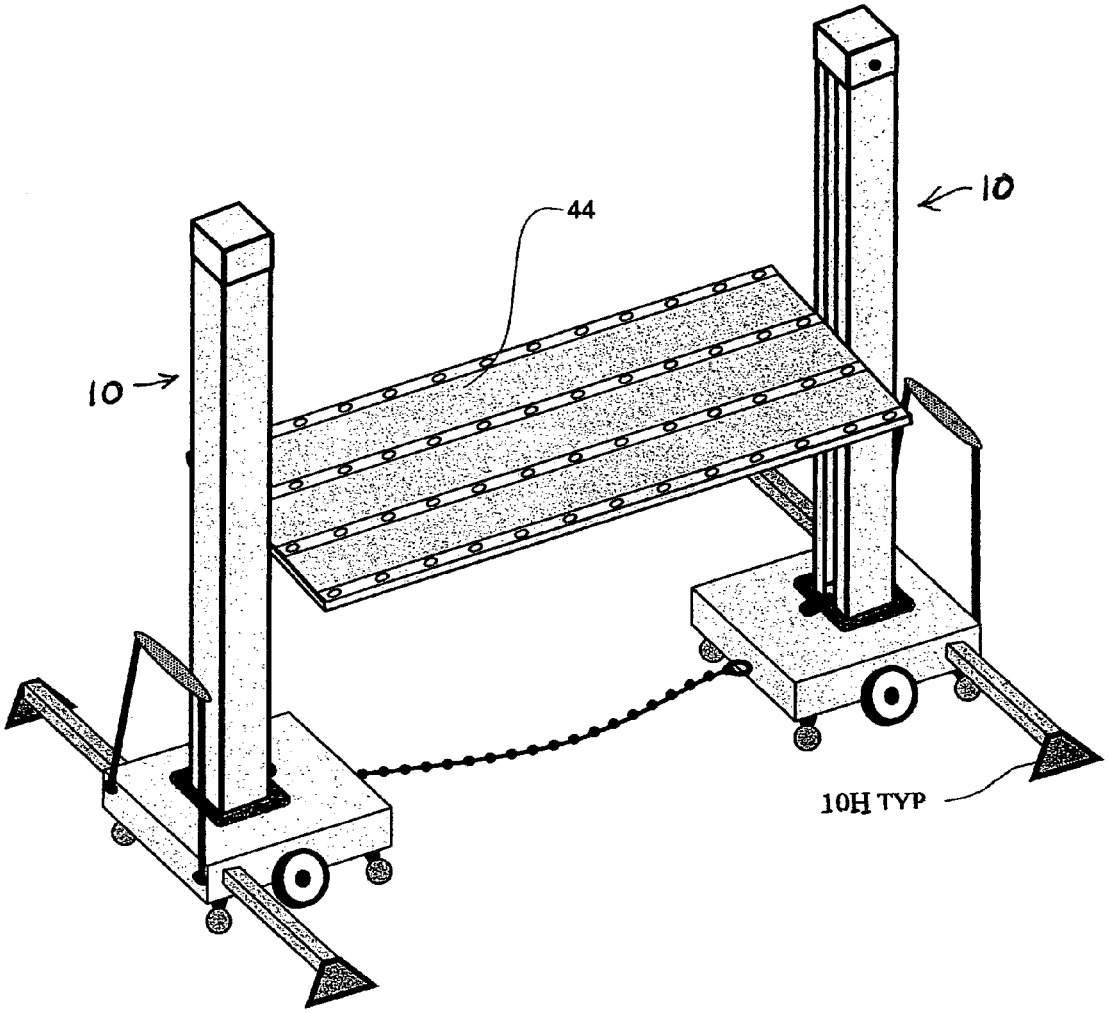
FIG. 9 is a three-dimensional view showing a height-adjustable platform system for installing ceiling panels such as drywall utilizing two linear drive machines of the present invention.

FIG. 9 is a three-dimensional view showing two linear drive machines 10 of the present invention, stabilized by base extension members 10H, utilized to handle a platform 44 to support a panel workpiece such as drywall or other sheet board to be installed in an unfinished ceiling above.

Figure 10:
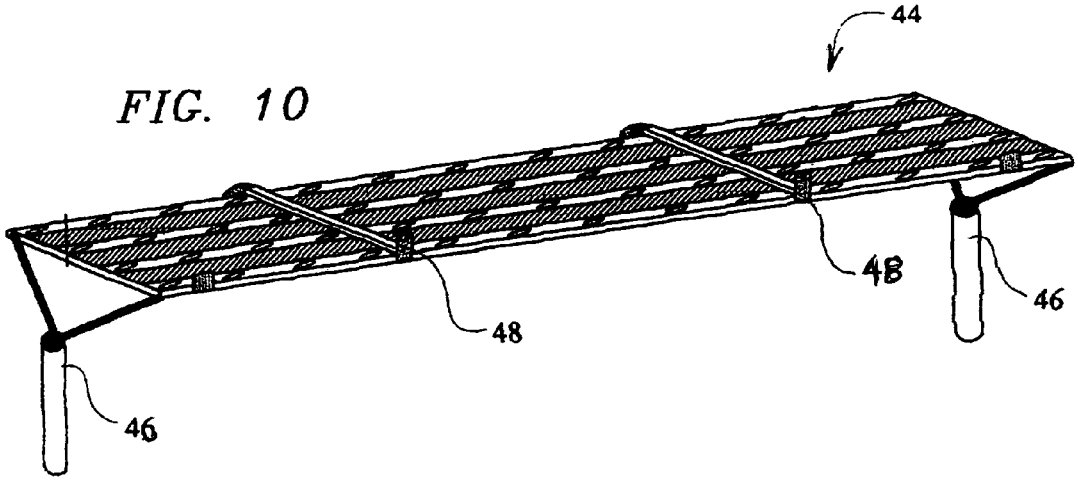
FIG. 10 is a three-dimensional view of the platform of FIG. 9

FIG. 10 is a three-dimensional view of the platform 44 of FIG. 9 showing a pair of spacer strips 48 for handling the panel workpiece and a pair of end supports 46 extending downwardly to engage the driving members of the drive machines and made long enough to raise platform 44 to the required ceiling height.

Figure 10A:
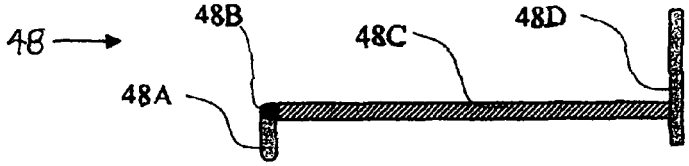
FIG. 10A is a side view of one of the two spacer strips of FIG. 10.

FIG. 10A is a side view of a spacer strip 48 showing a downward portion 48A at corner 48B and a main horizontal portion 48C to which is removably attached an upward end portion 48D, for supporting and retaining a panel workpiece on the platform 44 of FIG. 10.

Figure 10B:
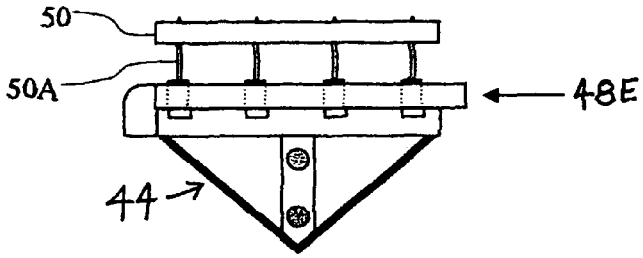
FIG. 10B is an and end view of the platform of FIG. 10 and a portion of the spacer strip of FIG. 10A, supporting a panel workpiece with pre-inserted nails.

FIG. 10B is an end view of the platform of FIG. 10 showing a panel workpiece 50 in place with previously started nails 50A resting on the main portion 48E of spacer strips 48 after removal of the upward end portion 48D. At this point in the procedure the spacer main portion 48E is withdrawn to the left so that the nails 50A drop down with their heads in recessed regions shown in platform 44, such that now platform 44 with panel workpiece 50 can be raised to the ceiling level, pushing nails 50A further through panel workpiece 50 and at least partially into wood ceiling joists (not shown) sufficiently to support the panel workpiece in place, where final nailing can be performed as required after platform 44 is removed. This general procedure can also be adapted for purposes of installing workpiece panels such as drywall sheets onto walls.

Figure 11:
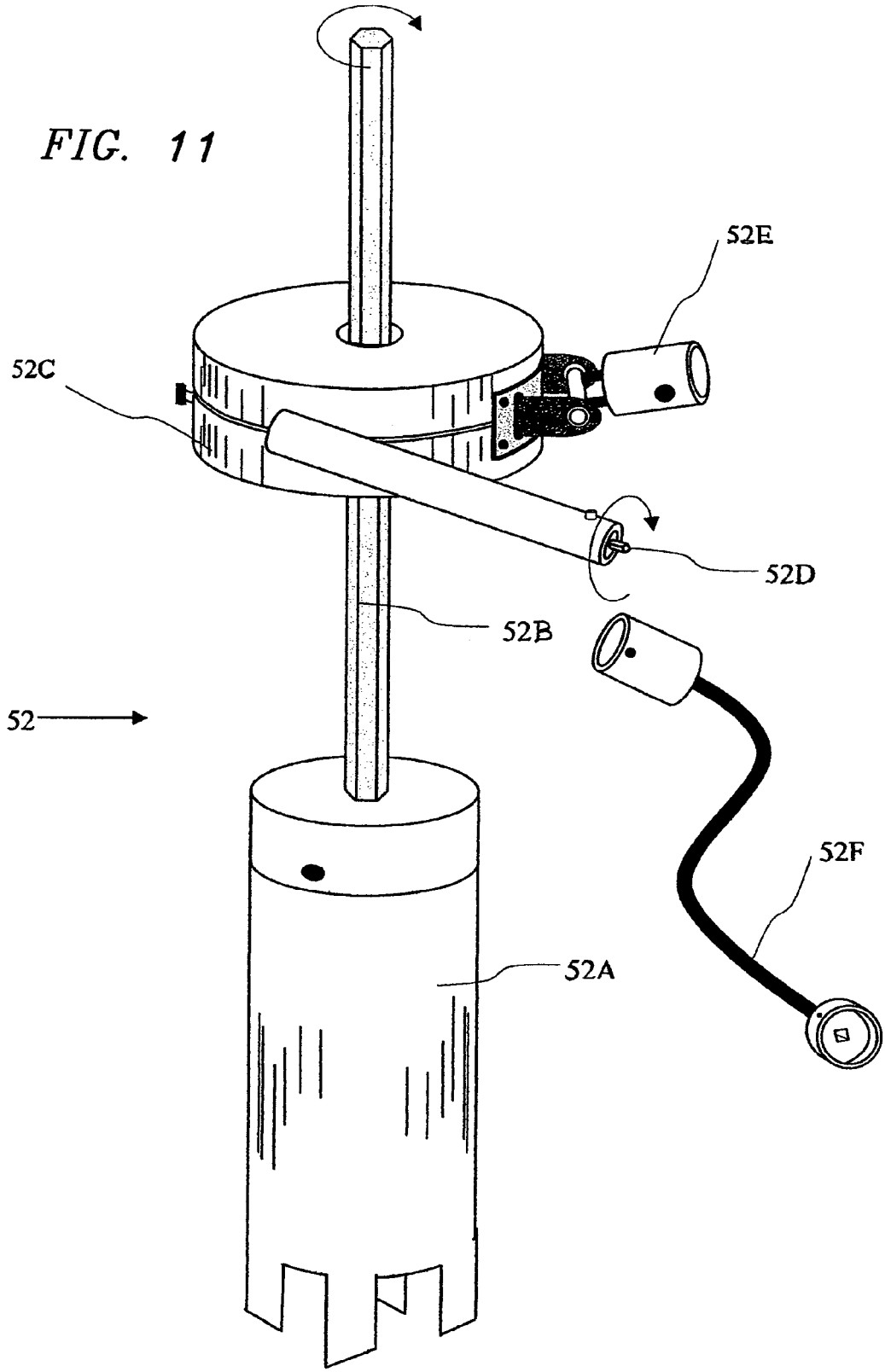
FIG. 11 is a three-dimensional view of a ground hole drill assembly that can be driven from the linear drive machine of the present invention.

FIG. 11 is a three-dimensional view of a ground hole drill assembly 52 that can be driven from a linear drive machine (10, FIG. 1) of the present invention. The auger 52A is mounted on drill-shaft 52B which is driven by a worm and pinion gear set inside gearbox 52C. The pinion is driven by input drive-shaft 52D which receives torque from the motor of the drive machine via a pair of bevel gears (18A and 18B as shown in FIGS. 5 and 5A) via either a solid shaft or alternatively a flexible drive cable 52F.

Figure 12:
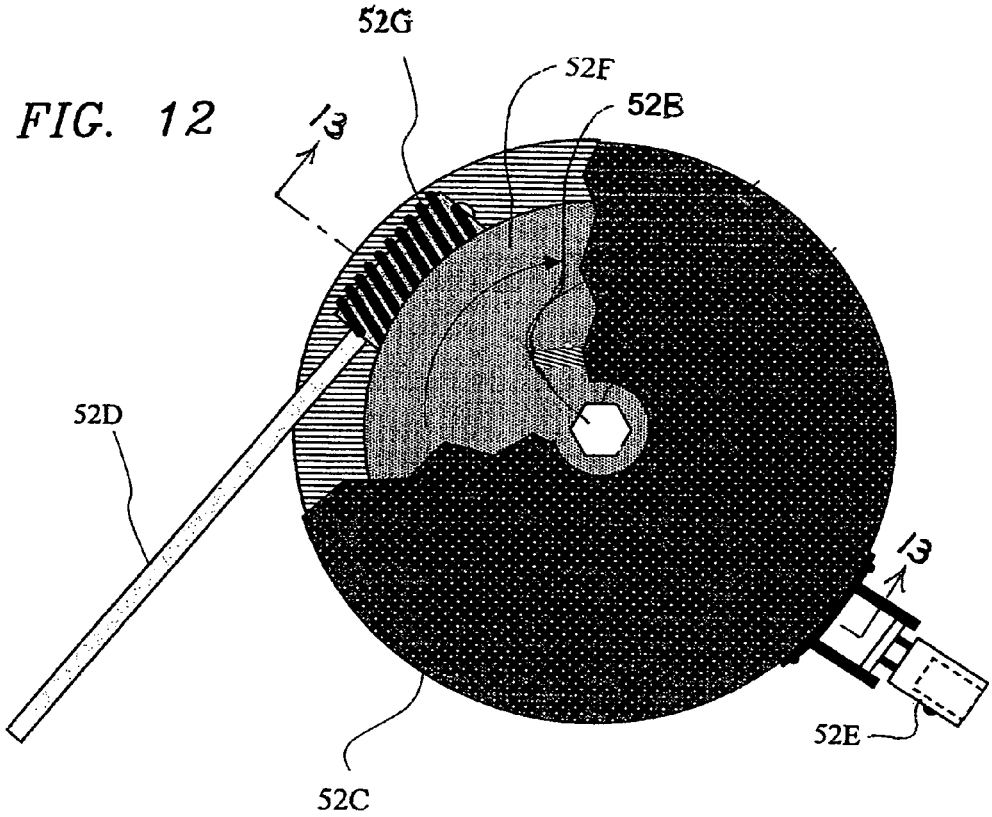
FIG. 12 is an enlarged top view of the gearbox of FIG. 11, shown partially cut away to reveal the internal worm gear set.

FIG. 12 is top view of the items in FIG. 11 with a portion of gearbox 52C cut away to reveal worm 52G, on drive-shaft 52D, engaging pinion 52F.

A radially-extending fitting 52E is provided for attachment to a suitable structural mass via a bar inserted in the socket opening; the bar may be braced for stabilization by a large mass such as the drill rig frame or alternatively it may be hand-held.

Drill-shaft 52B is seen to have a hexagonal cross-sectional shape that allows it to be shifted up or down in operation while receiving driving torque from pinion 52F. This sliding rotational coupling could also be implemented with other non-circular shape of the main drive-shaft 52B and the mating opening in the pinion gear, such as triangular, square or fluted, etc.

Figure 13:
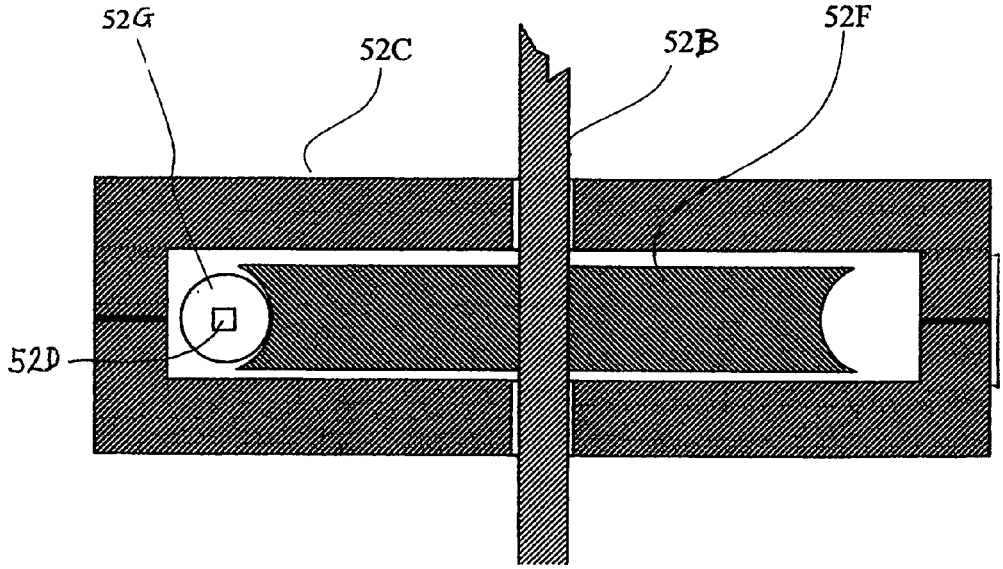
FIG. 13 is a cross-section of the gear box of FIG. 12

FIG. 13 is a cross-section of gearbox 52C taken through axis 13-13 of FIG. 12 showing worm 52G, on drive shaft 52D engaging pinion 52F which engages the drill-shaft 52B in a vertically slidable manner.

Figures 14, 15:
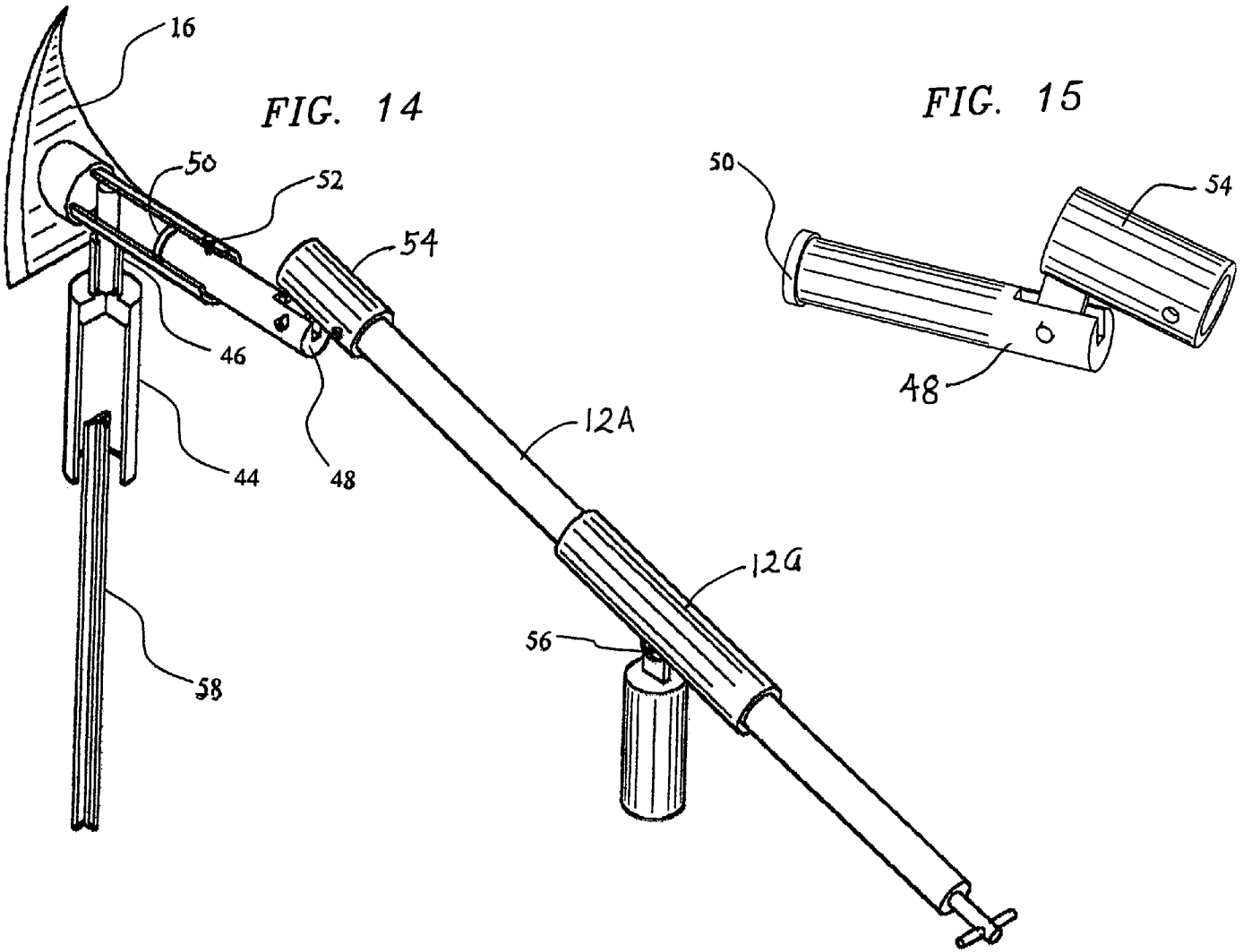
FIG. 14 is a three-dimensional view of a post driver assembly for hammering a post into the ground.
FIG. 15 is a three-dimensional view of an offset pivot portion of the post driver assembly of FIG. 14.

FIG. 14 is a three dimensional view of a post driver assembly having a weighted hammer head 44 formed as a sleeve sized to fit loosely over a post 58 and having a massive top end to provide weight and receive hammering. Hammer head 44 is firmly attached by a short connection member 46 to pick attachment 16, pinned in place.

The coupling between beam 12A (see FIG. 2) and pick attachment 16 is provided by the telescopic/pivot attachment of rod 48 fitted with an attached circular end disk 50 at the left hand end that fits in a sliding manner inside the tubular attachment sleeve opening of pick attachment 16 (shown partially cut away). A pair of screws 52, extending through the attachment sleeve wall near its open end, serve to captivate rod 48 within the sleeve. The right hand end of rod 48 is attached in a pivoted manner to sleeve member 54 which is attached securely to the end of beam 12A. Sleeve 12G, which forms the main fulcrum point of beam 12A, is preferably mounted on a pivot joint 56.

FIG. 15 is an enlarged view of the pivoted assembly of sleeve member 54, and rod 48 with ring 50.

The above described telescopic/pivot mechanism provides the degrees of freedom required to enable the hammer head 44 to travel in a straight vertical line as required for driving post 58 downwardly, while the pivot sleeve 54 and the end of beam 12A travel in an arcuate path with appreciable horizontal displacement.

In addition to the foregoing implementations in which the linear drive machine of the present invention is utilized in the vertical orientation shown, there are other implementations in which it may be oriented other than vertical; e.g. it may oriented horizontally for use in pulling or pushing a load item directly or indirectly from the driving member 10F.

There are many ways in which the linear drive machine of the present invention may be utilized to facilitate many difficult tasks that are presently performed manually only because of excessive size, cost, non-versatility and/or non-availability of existing known powered work machines.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A linear drive machine providing versatile mobile mechanical power to an external tool comprising:

a base enclosure including mobility capability;

a motor located within said base enclosure;

an elongated column having an upper end and a lower end, said lower end attached to said base enclosure and further said elongated column extends upwardly with respect to said base enclosure;

an elongated slot configured in said elongated column;

a threaded shaft rotatably mounted within said elongated column and coupled to said motor in a manner to receive rotational drive therefrom;

a driving member engaging said threaded shaft to travel linearly in either of two opposite directions along the said elongated slot in response to rotation of said threaded shaft as driven by said motor;

an elongated tubular bean having a first and a second end, operationally attached at said first end to said driving member in pivotal manner to allow varying inclination of said beam;

an automatic release mechanism at an end point of said elongated slot, to disengage the said driving member;

said driving member being operationally coupled to drive said external tool;

a circular-hand-wheel affixed concentrically to said beam in a location near the said first end, and a mobile support stand made and arranged to support a central region of said beam via a sleeve bearing that allows rotation or said beam, said support stand thus acting as a fulcrum to elevate a second and opposite end of said beam when said driving member is driven downwardly and to lower the said second end of said beam when said driving member is driven upwardly; causing a reciprocating teeter-totter motion of said beam to perform a ground material related operation in a group that includes digging, trenching, picking, compacting and post hammering; and, said external tool is a shovel.

* * * * *